United States Patent [19]

De Ferrari et al.

[11] Patent Number: 4,500,038

[45] Date of Patent: Feb. 19, 1985

[54] POWDER FEED SYSTEM WITH RECIRCULATOR FOR PLASMA SPRAY APPARATUS

[75] Inventors: Alfred De Ferrari, Huntington; William H. Doddman, Trumbull, both of Conn.

[73] Assignee: Avco Corporation, Stratford, Conn.

[21] Appl. No.: 438,027

[22] Filed: Nov. 1, 1982

[51] Int. Cl.[3] ..... B05B 7/30; B05B 7/32

[52] U.S. Cl. ..... 239/85; 118/312; 239/127; 239/143; 406/106; 427/34; 427/423

[58] Field of Search ..... 406/106; 427/34, 195, 427/423; 118/312; 137/571; 239/79, 85, 124, 127, 143, 654, 655

[56] References Cited

U.S. PATENT DOCUMENTS

| | | | |
|---|---|---|---|
| 2,233,304 | 2/1941 | Bleakley | 239/85 X |
| 2,884,895 | 5/1959 | Lopenski et al. | 118/312 X |
| 3,501,097 | 3/1970 | Daley | 239/85 |
| 3,901,184 | 8/1975 | Payne et al. | 118/312 X |
| 4,291,640 | 9/1981 | Payne et al. | 118/312 X |
| 4,314,669 | 2/1982 | Moos | 406/106 X |

*Primary Examiner*—Andres Kashnikow

*Attorney, Agent, or Firm*—Ralph D. Gelling

[57] ABSTRACT

A powder feed system with a recirculator is provided for a plasma spray apparatus so that spraying operations may be started and stopped abruptly. The subject system utilizes a pressurized gas to direct a powdered material from a powder feed hopper to the plasma spray applicator. A diverter valve is located intermediate the powder feed hopper and the plasma spray applicator and in close proximity to the plasma spray applicator for selectively diverting the powdered material toward or away from the plasma spray applicator. Powdered material diverted away from the plasma spray applicator is directed to a powder accumulator for subsequent reuse. The powdered material is kept in continuous motion during both spraying and diverting operations thereby avoiding the need to overcome inertia each time spraying operations are commenced. Furthermore, because of the close proximity of the diverter valve to the plasma spray applicator, spraying operations may be started and stopped abruptly with little or no transition period of variable flow rate. In a preferred embodiment the powder accumulator is in communication with the powder feed hopper thereby facilitating the recirculation and reuse of the diverted powdered material.

8 Claims, 4 Drawing Figures

POWDER FEED SYSTEM WITH RECIRCULATOR FOR PLASMA SPRAY APPARATUS

BACKGROUND OF THE INVENTION

A plasma spray apparatus is employed for spraying powdered material to provide a permanent coating on all or part of a workpiece. This is done to modify the surface characteristics of the workpiece, for example, to change the dimensions of the workpiece, to make the workpiece more adaptable to temperature variations, to vary the coefficient of friction of the workpiece surface, to alter the ability of the workpiece to withstand exposure to abrasive chemicals and environment, etc.

A plasma spray apparatus utilizes powdered materials such as metals, ceramics, intermetallics or plastics. The powdered materials are carried to the plasma flame or stream by a powder feed system that utilizes a metering device and a feed tube. The powdered material is carried through the feed tube and toward the plasma flame by a pressurized gas. The powdered particles then pass through the plasma flame, where temperatures are typically in the range of 12,000 F. to 20,000 F., and are carried to and deposited on the workpiece.

Prior art plasma spray or powder feed systems require several seconds, typically eight or nine seconds, from the time the entire system is activated until a uniform flow of powdered material passing through the system is obtained. During this transition period, the rate of flow of powder will gradually increase from zero up to the desired rate for application on the workpiece. Similarly, when a prior art system is deactivated, several seconds elapse before the flow of powder stops completely. This elapsed or transition time is caused in part by the distance from the reservoir or hopper where the powder is stored to the workpiece. Additionally, the pressurized gas and the powder must overcome inertia to be accelerated during activation of the system, and decelerated during deactivation of the system.

This inertial phenomena of a variable flow rate during the transition period immediately following activation or deactivation of the prior art systems causes operating problems and inefficiencies. Specifically, workpiece specifications typically require the application of a uniform thickness of plasma spray powder. However, as mentioned above, the rate of flow of powder varies during the transition period following activation or deactivation of the plasma spray system. Therefore, to insure a uniform application of the powdered material on the workpiece, a prior art system must be activated and sprayed for several seconds before directing the plasma spray on the area to be coated. Similarly, the time required for deactivation of the prior art feed system cannot be commenced until after the plasma spray powder has been applied to the entire area for which the coating is required. As a result, the powder expended during the activation and deactivation periods is wasted causing a substantial inefficiency in the operation of the prior art plasma spray system. Furthermore, since the powdered materials used with plasma spray systems is extremely expensive, inefficiencies caused by the activation and deactivation periods adds significantly and unnecessarily to the cost of operating the system.

The magnitude of the loss caused by the elapsed or transition time in activating and deactivating a prior art feed system varies according to the workpiece. In certain applications, for example, it is desirable to apply a uniform thickness of plasma spray coating to one area of the workpiece without applying it to adjacent areas. To overcome the problem of variable flow rates during the transition period immediately after activation or deactivation of the system, a prior art plasma spray applicator would be directed at areas of the workpiece for which no coating is desired until the maximum flow is achieved. The spray then would be directed at the area to be coated, but then would be directed to another area for which no coating is desired during the deactivation period. A separate machining step would then have to be carried out to remove the plasma spray coating that was applied during the activation and deactivation of the prior art plasma spray system. As an alternative to machining the unwanted plasma spray coating of the workpiece, the workpiece could be initially masked adjacent to the area for which the coating is intended. Thus, the plasma spray would be directed at the masked area during the transition periods of powder feed. These machining and masking operations are time-consuming and add significantly to the manufacturing cost. Furthermore, as mentioned above, there is a substantial amount of costly powder wasted during the activation and deactivation, i.e., transition, periods when utilizing prior art feed systems in a plasma spray apparatus.

The magnitude of the inefficiencies described above is even greater in applications where a single workpiece includes several areas for which a uniform coating of plasma spray material is desired. Because of the time required to activate and deactivate the system, it becomes virtually impossible to shut the system down while moving the plasma spray applicator from one area of desired application to the next. As a result, the plasma spray system is operated at its peak application rate even in areas between the areas of desired application. Thus, the plasma spray material is applied at its full thickness in these areas and afterwards must be removed by machining or removal of the mask. In applications such as this, the amount of powder wasted may easily exceed the amount of powder applied.

Accordingly, it is an object of the subject invention to provide a plasma spray apparatus on which the flow of powdered materials may be started and stopped abruptly without a transition period of variable flow rate.

It is a further object of the subject invention to provide a plasma spray apparatus that avoids the need to machine or mask the areas adjacent to the parts of the workpiece on which the plasma spray coating is desired.

It is still a further object of the subject invention to provide a plasma spray apparatus that will significantly reduce the cost and time required to properly coat a workpiece.

SUMMARY OF THE INVENTION

The plasma spray apparatus of the subject invention includes a powder feed hopper capable of storing a relatively large volume of powdered material for application on the workpiece. The powder feed hopper includes a means, such as a metering wheel, for feeding powder at a predetermined rate into a powder feed tube. The powder feed tube extends from the powder feed hopper to a plasma spray applicator. Typically, the plasma spray applicator is a gun and includes a flame which operates in the range of 12,000 F. to 20,000 F. The flame heats the powder and the workpiece prior to application of the powder on the workpiece. A pressure source is provided to direct a pressurized gas into the powder feed tube at the powder feed hopper. The powdered material is interspersed in the pressurized gas and is carried through the powder feed tube toward the applicator as a gas-powder mixture. A powder accumulator also is provided, and is connected to the powder feed tube by a diversion tube or other similar device. The diversion tube is connected to the powder feed tube at a location on the powder feed tube close to the plasma spray applicator. A valve means is provided at the connection between the powder feed tube and the diversion tube enabling the gas-powder mixture traveling through the powder feed tube to be alternately diverted to either the plasma spray applicator or the powder accumulator. A recirculation tube with a recirculation valve can connect the powder accumulator to the powder feed hopper to enable the powder to be recirculated from the powder accumulator to the powder feed hopper. Gas tubes also may be provided to alternately direct a flow of pressurized gas into either the powder feed hopper or the powder accumulator, and a vent and vent valve may be provided on the powder accumulator to selectively allow the release of gas therefrom.

During periods when it is desired not to coat the workpiece with the plasma spray coating, the gas-powder mixture traveling through the powder feed tube is directed from the plasma spray applicator to the powder accumulator by means of the diversion tube. The close proximity of the diversion tube to the plasma spray applicator enables the powder flowing to the workpiece to be ceased abruptly. Thus, there is no transition period during which the flow of powder onto the workpiece varies. During these periods the vent valve on the vent in the powder accumulator may be opened to enable the gas from the gas-powder mixture to escape from the powder accumulator and to allow the powder to remain therein.

Conversely, during periods when it is desirable to apply the powdered material to the workpiece, the gas-powder mixture is directed toward the plasma spray applicator, the vent in the powder accumulator may be closed, and forced gas may be injected into the powder accumulator to recirculate the powder therein to the powder feed hopper. The gas-powder mixture traveling from the powder accumulator through the recirculation tube into the powder feed hopper functions to facilitate the movement of powdered material in the powder feed hopper from the powder feed tube.

During periods of both application and diversion, the powder is continuously moving through the powder feed tube. Therefore, the inertial problem associated with activation of the system is avoided when the powder is directed back to the plasma spray applicator from the diversion tube.

DESCRIPTION OF THE PREFERRED EMBODIMENT

Figure 1:
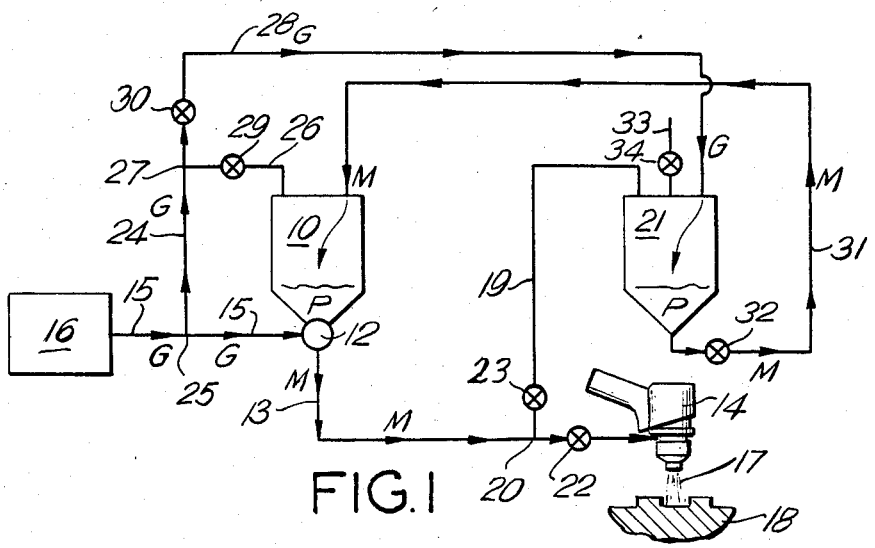
FIG. 1 is a schematic diagram of the plasma spray system of the subject invention adjusted to enable the application of the powdered material onto the workpiece.

Referring to FIG. 1, the plasma spray system of the subject invention includes a powder feed hopper 10 with a supply of powder P stored therein. The powder feed hopper 10 is typically a one-to-ten gallon container. Metering wheel 12 is attached to powder feed hopper 10 and feeds stored powder P into powder feed tube 13. Powder feed tube 13 extends from the metering wheel 12 to plasma spray applicator 14. Powder feed gas tube 15 is connected to powder feed tube 13 at metering wheel 12, and directs pressurized gas indicated by arrows G from pressure source 16 into powder feed tube 13. The gas G is mixed with powder P from the powder feed hopper 10 and moves as a gas-powder mixture M through powder feed tube 13 toward powder applicator 14. The powder applicator 14 provides a flame with a maximum temperature in the range of 12,000 F. to 20,000 F. The flame heats the gas-powder mixture M and the workpiece 18. The heated gas-powder mixture M then is applied as plasma stream 17 to workpiece 18.

Diversion tube 19 is connected to powder feed tube 13 at location 20 which is in close proximity to plasma spray applicator 14. Diversion tube 19 extends from powder feed tube 13 at location 20 to powder accumulator 21. Valve 22 is located on powder feed tube 13 between plasma spray applicator 14 and location 20 where diversion tube 19 meets powder feed tube 13. Valve 23 is located on diversion tube 19 near connection 20 of diversion tube 19 to powder feed tube 13. Valves 22 and 23 operate as a pair such that when one is opened, the other is closed. As shown by the arrows in FIG. 1, valve 23 is in the closed position thereby prohibiting the gas-powder mixture M to travel through diversion tube 19 to powder accumulator 21. Valve 22, on the other hand, is opened thereby enabling the gas-powder mixture M to travel through powder feed tube 13 to plasma spray applicator 14 and onto workpiece 18 in the form of plasma stream 17. Although valves 22 and 23 are schematically shown as being separate, a single valve at location 20 could be provided to direct gas-powder mixture M selectively and alternatively to either plasma spray applicator 14 or diversion tube 19.

Gas tube 24 is connected to powder feed gas tube 15 at T-connection 25, and carries gas G from pressure source 16. Although gas tube 24 and powder feed gas tube 15 are depicted as being connected to a single pressure source 16 they could be connected to separate pressure sources. Hopper gas tube 26 extends from gas tube 24 at T-connection 27 to powder feed hopper 10. Accumulator gas tube 28 extends from gas tube 24 at T-connection 27 to powder accumulator 21. Hopper gas tube valve 29 located on hopper gas tube 26 and accumulator gas tube valve 30 located on accumulator gas tube 28 operate as a pair such that when one is opened, the other is closed. In FIG. 1, as shown by the arrows, hopper gas tube valve 29 is closed and accumulator gas tube valve 30 is opened. As a result, there is no gas flowing through hopper gas tube 26. Conversely, gas G from pressure source 16 flows through gas tube 24 and through accumulator gas tube 28 into powder accumulator 21. Hopper gas tube valve 29 and accumulator gas tube valve 30 could be replaced by a single valve located at the T-connection 27.

Recirculation tube 31 extends from powder accumulator 21 to powder feed hopper 10. Recirculation tube valve 32 is located on recirculation tube 31 to selectively permit the gas-powder mixture M to travel through recirculation tube 31 toward powder feed hopper 10.

Vent 33 with vent valve 34 is connected to powder accumulator 21 to selectively permit gas G to escape from powder accumulator 21 as described below.

In operation, gas G travels through powder feed gas tube 15 into powder feed tube 13 at metering wheel 12. Simultaneously, powder P is released from powder feed hopper 10 and dispensed into powder feed tube 13 by metering wheel 12. Gas G and powder P combine in the metering wheel 12 to form gas-powder mixture M which travels through powder feed tube 13. As shown in FIG. 1, diversion tube valve 23 is closed and powder feed tube valve 22 is opened. Therefore, gas-powder mixture M continues through powder feed tube valve 22 to plasma spray applicator 14. Heat is applied to gas-powder mixture M at plasma spray applicator 14 to form plasma stream 17 which is applied to workpiece 18.

Gas G from pressure source 16 also is directed through gas tube 24. Hopper gas tube valve 29 is closed and accumulator gas tube valve 30 is opened. Therefore, gas G from gas tube 24 flows through accumulator gas tube valve 30 and through accumulator gas tube 28 into the powder accumulator 21. Vent valve 34 on vent 33 is closed thereby prohibiting gas G which enters powder accumulator 21 through accumulator gas tube 28, to be released through vent 33. However, recirculation valve 32 is opened. As a result, gas G from accumulator gas tube 28 will flow through powder accumulator 21 and through recirculation tube 31 into powder feed hopper 10, thereby facilitating the powder P in powder feed hopper 10 to be forced into powder feed tube 13 through metering wheel 12. If, as shown in FIG. 1, powder P is accumulated in powder accumulator 21, the gas G traveling through accumulator gas tube 28 will mix with powder P in powder accumulator 21. The resultant gas-powder mixture M will be forced through recirculation tube 31 to powder feed hopper 10. The powder P from the gas-powdered mixture M that enters powder feed hopper 10 through recirculation tube 31 will be stored in powder feed hopper 10 while the gas G from the gas-powder mixture M facilitates the movement of powder P in powder feed hopper 10 into powder feed tube 13.

By this operation, powder P from powder feed hopper 10 is directed through powder feed tube 13 to plasma spray applicator 14 at a constant rate to achieve a uniform coating of plasma spray on workpiece 18.

Figure 2:
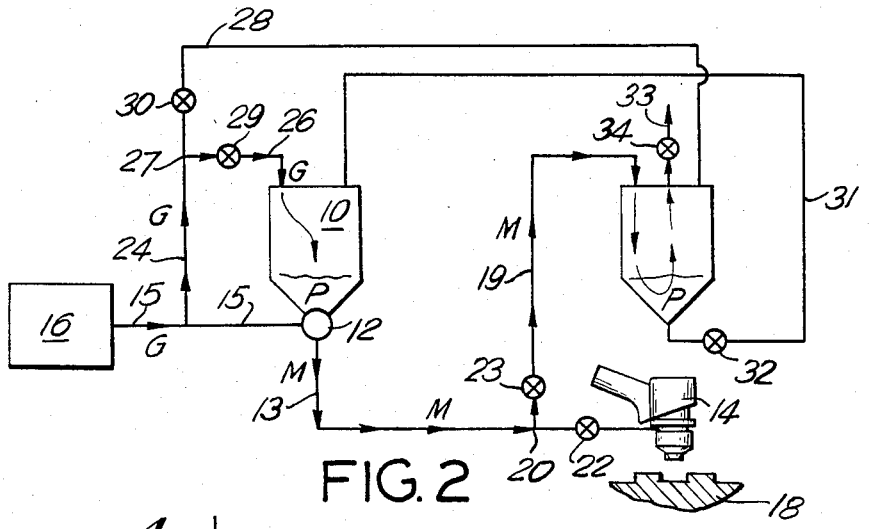
FIG. 2 is a schematic view of the plasma spray system of the subject invention adjusted to divert the powder material to the powder accumulator instead of onto the workpiece.

FIG. 2 shows the plasma spray system of the subject invention adjusted to prohibit the flow of powder P to plasma spray applicator 14. In this arrangement, accumulator gas tube valve 30 is closed and hopper gas tube valve 29 is opened. As a result, gas G is directed through hopper gas tube 26 and into powder feed hopper 10 instead of being directed through accumulator gas tube 28 and into powder accumulator 21 as had been shown in FIG. 1. The gas G that enters powder feed hopper 10 in FIG. 2 facilitates the movement of powder P into metering wheel 12 where it mixes with gas G to form gas-powder mixture M, and travels through gas feed tube 13. FIG. 2 also shows that powder feed tube valve 22 is closed and diversion tube valve 23 is opened. As a result, gas-powder mixture M is directed through diversion tube 19 into powder accumulator 21 instead of continuing through powder feed tube 13 to plasma spray applicator 14 as had been the case in FIG. 1.

FIG. 2 also shows recirculation tube valve 32 in a closed position. As a result, the gas-powder mixture M cannot travel through recirculation tube 31 from powder accumulator 21 to powder feed hopper 10. Vent valve 34 is opened in FIG. 2, thereby enabling gas G from the gas-powder mixture M that enters powder accumulator 21 through diversion tube 19 to be released through vent 33. On the other hand, the powder P from the gas-powder mixture M that enters powder accumulator 21 through diversion tube 19 remains in powder accumulator 21.

All the valves shown in FIGS. 1 and 2 are electronically operated and are connected to one another so that the valves can be changed simultaneously from the open/shut arrangement shown in FIG. 1 to the arrangement shown in FIG. 2, or the reverse. In other words, by a single switch, the system can be changed from the spraying and recirculating arrangement of FIG. 1 to the accumulating arrangement of FIG. 2.

As mentioned above, the plasma spray applicator 14 is in close proximity to connection 20 between diversion tube 19 and powder feed tubes 13. Thus, in switching from the arrangement shown in FIG. 1 to the arrangement shown in FIG. 2, there is an abrupt cessation of the spraying operation with virtually no transition period. Conversely, when a spraying operation is started by switching from the arrangement in FIG. 2 to the arrangement in FIG. 1, the gas-powder mixture M flows into plasma spray applicator 14 immediately with virtually no transition period as had been the case in the prior art. Furthermore, the powder P is continuously moving both in the arrangement of FIG. 1 and the arrangement of FIG. 2. As a result, in switching from the FIG. 2 to the FIG. 1 arrangement, there is no need to overcome the inertia of stationary powder, and the powder flows immediately at its optimum rate.

Figure 3:
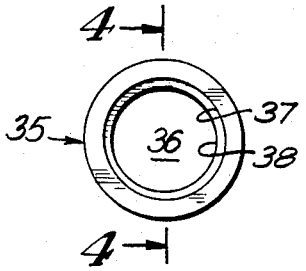
FIG. 3 is a cross-sectional view of a cylindrical workpiece having annular grooves disposed in a central bore, and having the plasma spray coating applied in the grooves.
Figure 4:
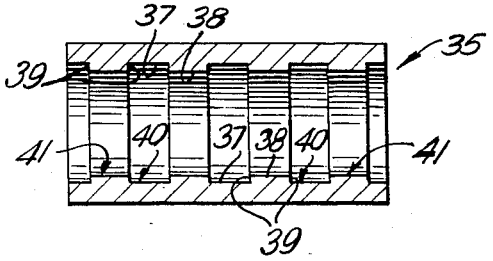
FIG. 4 is a cross-sectional view taken perpendicular to the longitudinal axis of the cylindrical workpiece of FIG. 3.

FIGS. 3 and 4 show a sample cylindrical workpiece 35 with a central bore 36 defined by alternating cylindrical surfaces 37 and 38, and radially aligned surfaces 39 extending between surfaces 37 and 38. By this arrangement, as shown in FIG. 4, bore 36 of cylindrical workpiece 35 has alternating annular grooves 40 and annular ridges 41. Product specifications require a plasma spray coating on surface 38 of the ridges 41, but not on surfaces 37 and 39 of the grooves 40. The prior art system, as explained above, would achieve the required product in one of two ways. First, the entire bore 36 of workpiece 35 could be coated, and then the coating could be machined off surfaces 37 and 39. Second, surfaces 37 and 39 could be masked prior to spraying. Then the entire workpiece could be coated and the masking would be removed afterward.

The subject invention substantially reduces the time, effort and cost to properly coat surface 38 of workpiece 35. To accomplish this coating, the plasma spray applicator 14 is directed radially at surfaces 38 of an annular ridge 41 in bore 36 of workpiece 35 while the plasma spray system is arranged as shown in FIG. 1. Workpiece 35 is rotated about its longitudinal axis to enable complete and even coating of the surface 38. As soon as surface 38 of one annular ridge 41 is coated, the system is switched to the arrangement shown in FIG. 2. The powder P stops flowing immediately, and the plasma spray applicator 14 is moved axially into alignment with the next annular ridge 41 in bore 36, without coating surfaces 37 and 39. Once the plasma spray applicator is directed to surface 38 of the next annular ridge 41 in bore 36, the system is switched back to the arrangement shown in FIG. 1, and the coating operation is commenced at its optimum rate with virtually no transition period.

In summary, a plasma spray system is provided that can quickly and abruptly stop spraying operations and quickly and abruptly start spraying operations thereby avoiding the transition period that follows the activation and deactivation of the prior art plasma spray system. As explained above, there are substantial cost and time savings in this unique plasma spray system.

While the preferred embodiment of the subject invention has been described and illustrated, it would be obvious that various changes and modifications can be made therein without departing from the spirit of the invention which should be limited only by the scope of the appended claims. For example, the system could be provided without the recirculation tube. In that particular embodiment, when the powder accumulator becomes sufficiently filled, it could be manually or mechanically removed for subsequent reuse of the powdered material therein. More specifically, the filled powder accumulator could be emptied and then returned to its position, or removed and replaced by an interchangeable substitute. In such an arrangement, the powder feed hopper and the powder accumulator could be interchangeable. Similarly, the apparatus could be provided without the hopper gas tube or the accumulator gas tube. Gravity could be relied upon to urge the powdered material from the powder feed hopper and, in applications, using a recirculation tube the force of the moving powder could be relied on to urge the powdered material from the powder accumulator. This feed system can be used in any powder metallizing apparatus.

What is claimed is:

1. An apparatus for spraying a powder material on a workpiece to provide a coating thereon, said apparatus being adapted for rapid starting and stopping of spraying operations, said apparatus comprising:

means for storing and dispensing said powdered material;

means for applying said powdered material onto said workpiece;

powder feed means for carrying said powdered material from said means for storing and dispensing said powdered material to said means for applying said powdered material onto said workpiece;

diverting means in communication with said powder feed means intermediate said feed means and said means for applying said powdered material onto said workpiece, said diverting means being operative for selectively diverting said powedered material away from or towards said means for applying said powdered material onto said workpiece;

accumulator means in communication with said diverting means for receiving and storing any powdered material diverted from said means for applying said powdered material onto said workpiece;

recirculation means for recirculating said powdered material from said accumulator means to said means for storing and dispensing said powdered material;

a source of pressurized gas in commumication with said powder feed means, with said means for storing and dispensing said powdered material and with said accumulator means, such that gas from said source of pressurized gas is operative to mix with and carry said powdered material towards said means for applying said powdered material onto said workpiece, to urge said powdered material from said means for storing and dispensing said powdered material to said powder feed means; and to urge said powdered material from said accumulator means into said recirculation means and said means for storing and dispensing said powdered material; and a gas directing means in communication with said source of pressurized gas for selectively directing pressurized gas either to said means for storing and dispensing said powdered material or to said accumulator means.

2. An apparatus as in claim 1 wherein said gas directing means comprises an accumulator gas valve means in communication with said accumulator means, and a storage gas valve means in communication with said means for storing and dispensing said powdered material, said accumulator gas valve means and said storage gas valve means being operative to selectively control the flow of pressurized gas from said source of pressurized gas to either said accumulator means or said means for storing and dispensing said powdered material.

3. An apparatus as in claim 1 further comprising a recirculation valve means in communication with said recirculation means for selectively controlling the recirculation of said powdered material from said accumulator means to said means for storing and dispensing said powdered material.

4. An apparatus as in claim 1 wherein said diverting means comprises a diversion tube extending from said powder feed means to said accumulator means, a diversion valve means on said diversion tube and an applicator valve means on said powder feed means intermediate said diversion tube and said means for applying said powdered material onto said workpiece.

5. An apparatus as in claim 1 wherein said means for storing and dispensing said powdered material includes a metering wheel for dispensing said powdered material at a predetermined constant rate.

6. An apparatus as in claim 5 wherein said diversion means is adjacent said means for applying said powdered material onto said workpiece.

7. A plasma spray apparatus for spraying a powdered material on a workpiece to provide a coating thereon, said apparatus being adapted for rapid starting and stopping of spraying operations, said apparatus comprising:

a powder feed hopper for storing and dispensing said powdered material;

a metering wheel adjacent said powder feed hopper for controlling the rate at which said powdered material is dispensed from said powder feed hopper;

plasma spray applicator for heating said powdered material and depositing said powdered material onto said workpiece;

a powder feed tube for carrying said powdered material to said plasma spray applicator, said powder feed tube extending from said metering wheel to said plasma spray applicator;

a gas pressure source for providing compressed gas to said plasma spray apparatus;

a powder feed gas tube extending from said gas pressure source to said powder feed tube for directing said compressed gas into said powder feed tube, said powdered material from said powder feed hopper mixing with said compressed gas from said powder feed gas tube and being directed through said powder feed tube away from said powder feed hopper;

an applicator valve connected to said powder feed tube adjacent said plasma spray applicator for selectively stopping the flow of said powdered material to said plasma spray applicator;

a diversion tube connected to said powder feed tube adjacent said applicator valve and between said applicator valve and said metering wheel, said diversion tube for carrying said powdered material diverted from said plasma spray applicator when said applicator valve is closed;

a powder accumulator connected to said diversion tube for storing said powdered material carried by said diversion tube when said applicator valve is closed;

a diversion valve located on said diversion tube for selectively stopping the flow of said powdered material through said diversion tube, said diversion valve being opened when said applicator valve is closed and said diversion valve being closed when said applicator valve is opened;

a recirculation tube extending from said powder accumulator to said powder feed hopper for carrying said powdered material from said powder accumulator to said powder feed hopper;

a recirculation valve located on said recirculation tube for selectively stopping the flow of said powdered material from said powder accumulator to said powder feed hopper;

an accumulator gas tube extending from said gas feed tube to said powder accumulator for directing said compressed gas into said powder accumulator thereby urging said powdered material from said powder accumulator through said recirculation tube and into said powder feed hopper;

an accumulator gas valve located on said accumulator gas tube for selectively stopping the flow of said compressed gas into said powder accumulator;

a hopper gas tube extending to said powder feed hopper from a location on said accumulator gas tube between said gas feed tube and said accumulator gas valve for directing said compressed gas into said powder feed hopper thereby urging said powdered material in said powder feed hopper through said metering wheel and into said powder feed tube;

a hopper gas valve located on said hopper gas tube for selectively stopping the flow of said compressed gas into said powder feed hopper, said hopper gas valve being opened when said accumulator gas valve is closed and said hopper gas valve being closed when said accumulator gas valve is opened; and a vent valve on said powder accumulator for selectively releasing said compressed gas therefrom, said vent valve being opened when said powdered material is directed through said diversion tube and into said powder accumulator, and said vent valve being closed when said powdered material is directed to said plasma spray applicator.

8. A plasma spray apparatus as in claim 7, wherein said applicator valve, said diversion tube valve, said recirculation valve, said hopper gas valve, said accumulator gas valve, and said vent valve are electronically operated.

* * * * *